US006911288B2

(12) United States Patent
Goodbrand et al.

(10) Patent No.: US 6,911,288 B2
(45) Date of Patent: Jun. 28, 2005

(54) PHOTOSENSITIVE MEMBER HAVING NANO-SIZE FILLER

(75) Inventors: H. Bruce Goodbrand, Hamilton (CA); Nan-Xing Hu, Oakville (CA); Ah-Mee Hor, Mississauga (CA); Cheng-Kuo Hsiao, Mississauga (CA); Yvan Gagnon, Mississauga (CA); Cuong Vong, Hamilton (CA)

(73) Assignee: Xerox Corporation, Stamford, CT (US)

( * ) Notice: Subject to any disclaimer, the term of this patent is extended or adjusted under 35 U.S.C. 154(b) by 76 days.

(21) Appl. No.: 10/439,065

(22) Filed: May 15, 2003

(65) Prior Publication Data

US 2004/0229141 A1 Nov. 18, 2004

(51) Int. Cl.[7] ..... G03G 5/14; G03G 5/047

(52) U.S. Cl. ..... 430/58.05; 430/66; 430/67; 399/159

(58) Field of Search ..... 430/58.05, 66, 430/67; 399/159

(56) References Cited

U.S. PATENT DOCUMENTS

| | | | | | |
|---|---|---|---|---|---|
| 5,008,167 | A | * | 4/1991 | Yu | 430/56 |
| 5,714,248 | A | * | 2/1998 | Lewis | 428/325 |
| 6,300,027 | B1 | * | 10/2001 | Chambers et al. | 430/58.2 |
| 2003/0134209 | A1 | * | 7/2003 | Itami | 430/58.2 |

* cited by examiner

*Primary Examiner*—John L Goodrow
(74) *Attorney, Agent, or Firm*—Annette L. Bade

(57) ABSTRACT

An imaging member having a substrate, a charge transport layer having charge transport materials dispersed therein, and an overcoat layer, wherein at least one of the charge transport layer and the overcoat layer comprise nano-size fillers having a particle size of from about 1 to about 250 nanometers.

19 Claims, 1 Drawing Sheet

PHOTOSENSITIVE MEMBER HAVING NANO-SIZE FILLER

CROSS REFERENCE TO RELATED APPLICATIONS

Attention is directed to U.S. patent application Ser. No. 10/316,234 filed Dec. 9, 2002, entitled, "Phase Change Ink Imaging Component with Nano-Size Filler." The disclosure of this reference is hereby incorporated by reference in its entirety.

BACKGROUND OF THE INVENTION

The present invention is directed to photosensitive members or photoconductors useful in electrostatographic apparatuses, including printers, copiers, other reproductive devices, and digital apparatuses. In specific embodiments, the present invention is directed to photosensitive members having nano-size fillers dispersed or contained in one or more layers of the photosensitive member. The nano-size fillers, in embodiments, provide a photosensitive member with a transparent, smooth, and less friction-prone surface. In addition, the nano-size fillers, in embodiments, provide a photosensitive member with longer life, and reduced marring, scratching, abrasion and wearing of the surface. Further, the photoreceptor, in embodiments, has a reduced or eliminated deletion. Moreover, the photoreceptor provides an improved filler, which has good dispersion quality in the selected binder, and has reduced particle porosity.

Electrophotographic imaging members, including photoreceptors or photoconductors, typically include a photoconductive layer formed on an electrically conductive substrate or formed on layers between the substrate and photoconductive layer. The photoconductive layer is an insulator in the dark, so that electric charges are retained on its surface. Upon exposure to light, the charge is dissipated, and an image can be formed thereon, developed using a developer material, transferred to a copy substrate, and fused thereto to form a copy or print.

Many advanced imaging systems are based on the use of small diameter photoreceptor drums. The use of small diameter drums places a premium on photoreceptor life. A major factor limiting photoreceptor life in copiers and printers, is wear. The use of small diameter drum photoreceptors exacerbates the wear problem because, for example, 3 to 10 revolutions are required to image a single letter size page. Multiple revolutions of a small diameter drum photoreceptor to reproduce a single letter size page can require up to 1 million cycles from the photoreceptor drum to obtain 100,000 prints, a desirable goal for commercial systems.

For low volume copiers and printers, bias charging rolls (BCR) are desirable because little or no ozone is produced during image cycling. However, the microcorona generated by the BCR during charging, damages the photoreceptor, resulting in rapid wear of the imaging surface, for example, the exposed surface of the charge transport layer. More specifically, wear rates can be as high as about 16 microns per 100,000 imaging cycles. Similar problems are encountered with bias transfer roll (BTR) systems.

One approach to achieving longer photoreceptor drum life is to form a protective overcoat on the imaging surface, for example, the charge transporting layer of a photoreceptor. This overcoat layer must satisfy many requirements, including transporting holes, resisting image deletion, resisting wear, and avoidance of perturbation of underlying layers during coating. One method of overcoating involves sol-gel silicone hardcoats.

Another approach to achieving longer life has been to reinforce the transport layer of the photosensitive member by adding fillers. Fillers that are known to have been used to increase wear include low surface energy additives and cross-linked polymeric materials and metal oxides produced both through sol-gel and gas phase hydrolytic chemistries.

Problems often arise with these materials since they are often difficult to obtain in, or reduce to, the nano-size regime (less than 100 nanometers). Fillers with larger particle sizes very often are effective scatterers of light, which can adversely affect device performance. Also, dispersion in the selected binder then often becomes a problem. Even with suitably sized material, particle porosity can be a major problem as pores can act as traps for gases and ions produced by the charging apparatus. When this occurs the electrical characteristics of the photoreceptor are adversely affected. Of particular concern is the problem of deletion, a phenomenon that causes fogging or blurring of the developed image.

Japan Patent No. P3286711 discloses a photoreceptor having a surface protective layer containing at least 43 percent by weight but no more than 60 percent by weight of the total weight of the surface protective layer, of a conductive metal oxide micropowder. The micropowder has a mean grain size of 0.5 micrometers or less, and a preferred size of 0.2 micrometers or less. Metal oxide micropowders disclosed are tin oxide, zinc oxide, titanium oxide, indium oxide, antimony-doped tin oxide, tin-doped indium oxide, and the like.

U.S. Pat. No. 6,492,081 B2 discloses an electrophotographic photosensitive member having a protective layer having metal oxide particles with a volume-average particle size of less than 0.3 micrometers, or less than 0.1 micrometers.

U.S. Pat. No. 6,503,674 B2 discloses a member for printer, fax or copier or toner cartridge having a top layer with spherical particles having a particle size of lower than 100 micrometers.

U.S. patent application Ser. No. 10/379,110, U.S. Publication No. 20030077531 discloses an electrophotographic photoreceptor, image forming method, image forming apparatus, and image forming apparatus processing unit using same. Further, the reference discloses an electroconductive substrate, the outermost surface layer of the electroconductive substrate containing at least an inorganic filler, a binder resin, and an aliphatic polyester, or, alternatively, the outermost surface layer of the electroconductive substrate containing at least an inorganic filler and a binder resin and the binder resin is a copolymer polyarylate having an alkylene-arylcarboxylate structural unit.

U.S. patent application Ser. No. 09/985,347, U.S. Publication No. 20030073015 A1, discloses an electrophotographic photoreceptor, and image forming method and apparatus using the photoreceptor including an electroconductive substrate, a photosensitive layer located overlying the electroconductive substrate, and optionally a protective layer overlying the photosensitive layer, wherein an outermost layer of the photoreceptor includes a filler, a binder resin and an organic compound having an acid value of from 10 to 700 mgKOH/g. The photosensitive layer can be the outermost layer. A coating liquid for an outermost layer of a photoreceptor including a filler, a binder resin, an organic compound having an acid value of from 10 to 700 mgKOH/g and plural organic solvents.

Therefore, there exists a need in the art for an improved method of increasing wear of a photosensitive member. In addition, there exists a need for a photoreceptor surface with decreased susceptibility to marring, scratching, micro-cracking, and abrasion. In addition, there exists a need in the art for a photoreceptor with a transparent, smoother, and less friction-prone surface. Further, there exists a need for a photoreceptor that has reduced or eliminated deletion. Moreover, there is a need in the art for an improved filler which has good dispersion quality in the selected binder, and has reduced particle porosity.

SUMMARY OF THE INVENTION

Embodiments of the present invention include an imaging member comprising a substrate; a charge transport layer comprising charge transport materials dispersed therein; and an overcoat layer, wherein at least one of the charge transport layer and the overcoat layer comprise nano-fillers having a particle size of from about 1 to about 250 nanometers.

Embodiments further include an imaging member comprising a substrate; a charge transport layer comprising charge transport materials dispersed therein; and an overcoat layer, wherein said overcoat layer comprises aluminum oxide nano-fillers having a particle size of from about 1 to about 250 nanometers.

In addition, embodiments include an image forming apparatus for forming images on a recording medium comprising a) a photoreceptor member having a charge retentive surface to receive an electrostatic latent image thereon, wherein said photoreceptor member comprises a substrate, a charge transport layer comprising charge transport materials therein, and an overcoat layer, wherein at least one of the charge transport layer and the overcoat layer comprise nano-fillers having a particle size of from about 1 to about 250 nanometers; b) a development component to apply a developer material to said charge-retentive surface to develop said electrostatic latent image to form a developed image on said charge-retentive surface; c) a transfer component for transferring said developed image from said charge-retentive surface to another member or a copy substrate; and d) a fusing member to fuse said developed image to said copy substrate.

BRIEF DESCRIPTION OF THE DRAWINGS

For a better understanding of the present invention, reference may be had to the accompanying figures.

DETAILED DESCRIPTION OF THE PRESENT INVENTION

The present invention relates to the use of nano-size fillers in a layer or layers of a photosensitive member to increase wear resistance and promote longer life of the photosensitive member. In addition, in embodiments, the nano-size filler provides a smoother, transparent, less friction-prone surface. Moreover, the nano-size fillers provide, in embodiments, decreased scratching, micro-cracking, marring and abrasion of the photosensitive member. Further, the photoreceptor, in embodiments, has a reduced or eliminated deletion. Moreover, the photoreceptor provides an improved filler which has good dispersion quality in the selected binder, and has reduced particle porosity.

Figure 1:
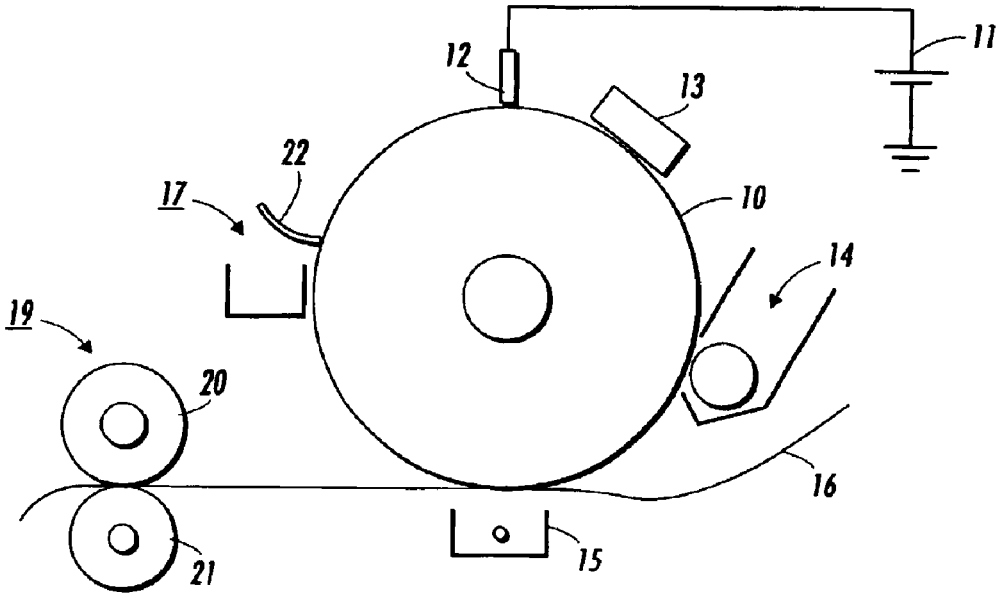
FIG. 1 is an illustration of a general electrostatographic apparatus using a photoreceptor member.

Referring to FIG. 1, in a typical electrostatographic reproducing apparatus, a light image of an original to be copied is recorded in the form of an electrostatic latent image upon a photosensitive member and the latent image is subsequently rendered visible by the application of electroscopic thermoplastic resin particles which are commonly referred to as toner. Specifically, photoreceptor 10 is charged on its surface by means of an electrical charger 12 to which a voltage has been supplied from power supply 11. The photoreceptor is then imagewise exposed to light from an optical system or an image input apparatus 13, such as a laser and light emitting diode, to form an electrostatic latent image thereon. Generally, the electrostatic latent image is developed by bringing a developer mixture from developer station 14 into contact therewith. Development can be effected by use of a magnetic brush, powder cloud, or other known development process.

After the toner particles have been deposited on the photoconductive surface, in image configuration, they are transferred to a copy sheet 16 by transfer means 15, which can be pressure transfer or electrostatic transfer. In embodiments, the developed image can be transferred to an intermediate transfer member and subsequently transferred to a copy sheet.

After the transfer of the developed image is completed, copy sheet 16 advances to fusing station 19, depicted in FIG. 1 as fusing and pressure rolls, wherein the developed image is fused to copy sheet 16 by passing copy sheet 16 between the fusing member 20 and pressure member 21, thereby forming a permanent image. Fusing may be accomplished by other fusing members such as a fusing belt in pressure contact with a pressure roller, fusing roller in contact with a pressure belt, or other like systems. Photoreceptor 10, subsequent to transfer, advances to cleaning station 17, wherein any toner left on photoreceptor 10 is cleaned therefrom by use of a blade 22 (as shown in FIG. 1), brush, or other cleaning apparatus.

Figure 2:
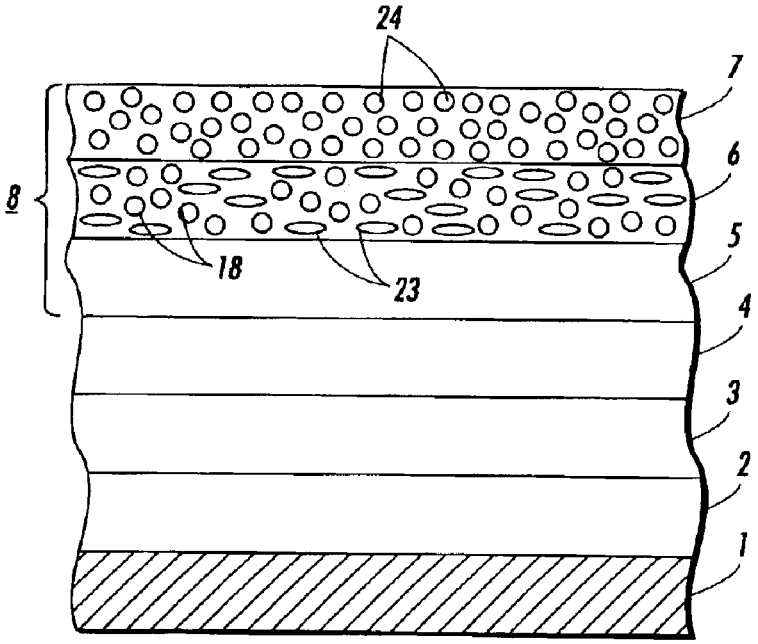
FIG. 2 is an illustration of an embodiment of a photoreceptor showing various layers and embodiments of filler dispersion.

Electrophotographic imaging members are well known in the art. Electrophotographic imaging members may be prepared by any suitable technique. Referring to FIG. 2, typically, a flexible or rigid substrate 1 is provided with an electrically conductive surface or coating 2.

The substrate may be opaque or substantially transparent and may comprise any suitable material having the required mechanical properties. Accordingly, the substrate may comprise a layer of an electrically non-conductive or conductive material such as an inorganic or an organic composition. As electrically non-conducting materials, there may be employed various resins known for this purpose including polyesters, polycarbonates, polyamides, polyurethanes, and the like which are flexible as thin webs. An electrically conducting substrate may be any metal, for example, aluminum, nickel, steel, copper, and the like or a polymeric material, as described above, filled with an electrically conducting substance, such as carbon, metallic powder, and the like or an organic electrically conducting material. The electrically insulating or conductive substrate may be in the form of an endless flexible belt, a web, a rigid cylinder, a sheet and the like. The thickness of the substrate layer depends on numerous factors, including strength desired and economical considerations. Thus, for a drum, this layer may be of substantial thickness of, for example, up to many centimeters or of a minimum thickness of less than a millimeter. Similarly, a flexible belt may be of substantial thickness, for example, about 250 micrometers, or of minimum thickness less than 50 micrometers, provided there are no adverse effects on the final electrophotographic device.

In embodiments where the substrate layer is not conductive, the surface thereof may be rendered electrically conductive by an electrically conductive coating 2. The conductive coating may vary in thickness over substantially wide ranges depending upon the optical transparency, degree of flexibility desired, and economic factors. Accordingly, for a flexible photoresponsive imaging device, the thickness of the conductive coating may be between about 20 angstroms to about 750 angstroms, or from about 100 angstroms to about 200 angstroms for an optimum combination of electrical conductivity, flexibility and light transmission. The flexible conductive coating may be an electrically conductive metal layer formed, for example, on the substrate by any suitable coating technique, such as a vacuum depositing technique or electrodeposition. Typical metals include aluminum, zirconium, niobium, tantalum, vanadium and hafnium, titanium, nickel, stainless steel, chromium, tungsten, molybdenum, and the like.

An optional hole blocking layer 3 may be applied to the substrate 1 or coatings. Any suitable and conventional blocking layer capable of forming an electronic barrier to holes between the adjacent photoconductive layer 8 (or electrophotographic imaging layer 8) and the underlying conductive surface 2 of substrate 1 may be used.

An optional adhesive layer 4 may be applied to the hole-blocking layer 3. Any suitable adhesive layer well known in the art may be used. Typical adhesive layer materials include, for example, polyesters, polyurethanes, and the like. Satisfactory results may be achieved with adhesive layer thickness between about 0.05 micrometer (500 angstroms) and about 0.3 micrometer (3,000 angstroms). Conventional techniques for applying an adhesive layer coating mixture to the hole blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like.

At least one electrophotographic imaging layer 8 is formed on the adhesive layer 4, blocking layer 3 or substrate 1. The electrophotographic imaging layer 8 may be a single layer (7 in FIG. 2) that performs both charge-generating and charge transport functions as is well known in the art, or it may comprise multiple layers such as a charge generator layer 5 and charge transport layer 6 and overcoat 7.

The charge generating layer 5 can be applied to the electrically conductive surface, or on other surfaces in between the substrate 1 and charge generating layer 5. A charge blocking layer or hole-blocking layer 3 may optionally be applied to the electrically conductive surface prior to the application of a charge generating layer 5. If desired, an adhesive layer 4 may be used between the charge blocking or hole-blocking layer 3 and the charge generating layer 5. Usually, the charge generation layer 5 is applied onto the blocking layer 3 and a charge transport layer 6, is formed on the charge generation layer 5. This structure may have the charge generation layer 5 on top of or below the charge transport layer 6.

Charge generator layers may comprise amorphous films of selenium and alloys of selenium and arsenic, tellurium, germanium and the like, hydrogenated amorphous silicon and compounds of silicon and germanium, carbon, oxygen, nitrogen and the like fabricated by vacuum evaporation or deposition. The charge-generator layers may also comprise inorganic pigments of crystalline selenium and its alloys; Group II–VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos; and the like dispersed in a film forming polymeric binder and fabricated by solvent coating techniques.

Phthalocyanines have been employed as photogenerating materials for use in laser printers using infrared exposure systems. Infrared sensitivity is required for photoreceptors exposed to low-cost semiconductor laser diode light exposure devices. The absorption spectrum and photosensitivity of the phthalocyanines depend on the central metal atom of the compound. Many metal phthalocyanines have been reported and include, oxyvanadium phthalocyanine, chloroaluminum phthalocyanine, copper phthalocyanine, oxytitanium phthalocyanine, chlorogallium phthalocyanine, hydroxygallium phthalocyanine magnesium phthalocyanine and metal-free phthalocyanine. The phthalocyanines exist in many crystal forms, and have a strong influence on photogeneration.

Any suitable polymeric film forming binder material may be employed as the matrix in the charge-generating (photogenerating) binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrenebutadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers.

The photogenerating composition or pigment is present in the resinous binder composition in various amounts. Generally, however, from about 5 percent by volume to about 90 percent by volume of the photogenerating pigment is dispersed in about 10 percent by volume to about 95 percent by volume of the resinous binder, or from about 20 percent by volume to about 30 percent by volume of the photogenerating pigment is dispersed in about 70 percent by volume to about 80 percent by volume of the resinous binder composition. In one embodiment, about 8 percent by volume of the photogenerating pigment is dispersed in about 92 percent by volume of the resinous binder composition. The photogenerator layers can also fabricated by vacuum sublimation in which case there is no binder.

The charge transport layer 6 may comprise a charge transporting small molecule 23 dissolved or molecularly dispersed in a film forming electrically inert polymer such as a polycarbonate. The term "dissolved" as employed herein is defined herein as forming a solution in which the small molecule is dissolved in the polymer to form a homogeneous phase. The expression molecularly dispersed is used herein is defined as a charge transporting small molecule dispersed in the polymer, the small molecules being dispersed in the polymer on a molecular scale. Any suitable charge transporting or electrically active small molecule may be employed in the charge transport layer of this invention. The expression charge transporting "small molecule" is defined herein as a monomer that allows the free charge photogenerated in the charge transport layer to be transported across the transport layer. Typical charge transporting small molecules include, for example. pyrazolines such as 1-phenyl-3-(4'-diethylamino styryl)-5-(4"-diethylamino phenyl) pyrazoline, diamines such as N,N'-diphenyl-N,N'-bis(3-methylphenyl)-(1,1'-biphenyl)-4,4'-diamine, hydrazones such as N-phenyl-N-methyl-(3-(9-ethyl)carbazyl hydrazone arid 4-diethyl amino benzaldehyde-1,2-diphenyl hydrazone, and oxadiazoles such as 2,5-bis (4-N,N'-diethylaminophenyl)-1,2,4-oxadiazole, stilbenes and the like. However, to avoid cycle-up in machines with high throughput, the charge transport layer should be substantially free (less than about two percent) of di or triaminotriphenyl methane. As indicated above, suitable electrically active small molecule charge transporting compounds are dissolved or molecularly dispersed in electrically inactive polymeric film forming materials. A small molecule charge transporting compound that permits injection of holes from the pigment into the charge transport layer with high efficiency and transports them across the charge transport layer with very short transit times is N,N'-diphenyl-N,N'-bis(3-methylphenyl)-(1,1'-biphenyl)44'-diamine. If desired, the charge transport material in the charge transport layer may comprise a polymeric charge transport material or a combination of a small molecule charge transport material and a polymeric Charge transport material.

Any suitable electrically inactive resin binder insoluble in the alcohol solvent used to apply the overcoat layer 7 may be employed in the charge transport layer of this invention. Typical inactive resin binders include polycarbonate resin, polyester, polyarylate, polyacrylate, polyether, polysulfone, and the like. Molecular weights can vary, for example, from about 20,000 to about 150,000. Examples of binders include polycarbonates such as poly(4,4'-isopropylidene-diphenylene)carbonate (also referred to as bisphenol-A-polycarbonate, poly(4,4'-cyclohexylidinediphenylene) carbonate (referred to as bisphenol-Z polycarbonate), poly(4,4'-isopropylidene-3,3'-dimethyl-diphenyl)carbonate (also referred to as bisphenol-C-polycarbonate) and the like. Any suitable charge transporting polymer may also be used in the charge transporting layer of this invention. The charge transporting polymer should be insoluble in the alcohol solvent employed to apply the overcoat layer of this invention. These electrically active charge transporting polymeric materials should be capable of supporting the injection of photogenerated holes from the charge generation material and be capable of allowing the transport of these holes there-through.

Any suitable and conventional technique may be used to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like.

Generally, the thickness of the charge transport layer is between about 10 and about 50 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layers can be maintained from about 2:1 to 200:1 and in some instances as great as 400:1. The charge transport layer, is substantially non-absorbing to visible light or radiation in the region of intended use but is electrically "active" in that it allows the injection of photogenerated holes from the photoconductive layer, i.e., charge generation layer, and allows these holes to be transported through itself to selectively discharge a surface charge on the surface of the active layer.

Crosslinking agents can be used in combination with the overcoat to promote crosslinking of the polymer, thereby providing a strong bond. Examples of suitable crosslinking agents include oxalic acid, p-toluene sulfonic acid, phosphoric acid, sulfuric acid, and the like, and mixtures thereof. The crosslinking agent can be used in an amount of from about 1 to about 20 percent, or from about 5 to about 10 percent, or about 8 to about 9 percent by weight of total polymer content.

The thickness of the Continuous overcoat layer selected depends upon the abrasiveness of the charging (e.g., bias charging roll), cleaning (e.g., blade or web). development (e.g., brush), transfer (e.g., bias transfer roll). etc., in the system employed and can range up to about 10 micrometers. In embodiments, the thickness is from about 1 micrometer and about 5 micrometers. Any suitable and conventional technique may be used to mix and thereafter apply the overcoat layer coating mixture to the charge transporting layer. Typical application techniques include spraying, dip coating, roll coating, wire wound rod coating, and tile like. Drying of the deposited coating may be effected by any suitable conventional technique such as oven drying, infrared radiation drying, air drying, and the like. The dried overcasting of this invention should transport holes during imaging and should not have too high a free carrier concentration. Free carrier concentration in the overcoat increases the dark decay. In embodiments, the dark decay of the overcoated layer should be about the same as that of the unovercoated device.

A nano-size filler can be added to a layer or layers in the photosensitive member. In embodiments, the nano-size filler is added to the charge transport layer 6 as filler 18, or the overcoat layer 7 as filler 24.

In embodiments, the nano-size filler is relatively simple to disperse, has extremely high surface area to unit volume ratio, has a larger interaction zone with dispersing medium, is non-porous, and/or chemically pure. Further, in embodiments, the nano-size filler is highly crystalline, spherical, and/or has a high surface area.

In embodiments, the nano-size filler is spherical or crystalline-shaped. The nano-size filler is prepared via plasma synthesis or vapor phase synthesis, in embodiments. This synthesis distinguishes these particulate fillers from those prepared by other methods (particularly hydrolytic methods), in that the fillers prepared by vapor phase synthesis are non-porous as evidenced by their relatively low BET values. An example of an advantage of such prepared fillers is that the spherical-shaped or crystalline-shaped nano-size fillers are less likely to absorb and trap gaseous corona effluents.

In embodiments, the nano-size filler has a surface area of from about 0.1 to about 75, or from about 20 to about 40, or about 42 $m^2/g$.

In embodiments, the nano-size filler is added to the layer or layers of the photosensistive member in an amount of from about 0.1 to about 30 percent, from about 3 to about 15 percent, or from about 5 to about 10 percent by weight of total solids.

Examples of nano-size fillers include fillers having an average particle size of from about 1 to about 250 nanometers, or from about 1 to about 199 nanometers, or from about 1 to about 195 nanometers, or from about 1 to about 175 nanometers, or from about 1 to about 150 nanometers, or from about 1 to about 100 nanometers, or from about 1 to about 50 nanometers.

Examples of suitable nano-size fillers include nano-size fillers prepared by vapor phase synthesis or plasma reaction. Specific examples of nano-size fillers include metal oxides such as silicon oxide, aluminum oxide, chromium oxide, zirconium oxide, zinc oxide, tin oxide, iron oxide, magnesium oxide, manganese oxide, nickel oxide, copper oxide, conductive antimony pentoxide and indium tin oxide, and the like, and mixtures thereof.

In embodiments, the nano-size filler can be prepared by plasma reaction of the filler, or by vapour phase synthesis, resulting in very high purity and very low porosity. In embodiments, a filler is prepared by plasma reaction of the nano-size filler. In this method, in a high vacuum flow reactor, a metal rod or wire is irradiated to produce intense heating creating plasma-like conditions. Metal atoms are boiled off and carried downstream where they are quenched and quickly cooled by a reactant gas, most notably oxygen, to produce spherical low porosity nano-sized metal oxides. Particle properties and size are controlled by the temperature profiles in the reactor as well as the concentration of the quench gas.

In embodiments, the nano-size fillers are surface treated to enable them to be more easily dispersed. The metal oxide nanoparticles are dispersed in an inert solvent by high power sonication for a suitable length of time. A surface-active agent or agents (such as organochlorosilanes, organosilane esters or their titanium analogs) is then added, and the mixture is heated to allow reaction with and passivation of the metal oxide surface. Removal of solvent then affords the surface-treated particle. The amount of surface treatment obtained can be ascertained by thermal gravimetric analysis. Generally, a 1 to 10% weight increase is observed indicating successful surface treatment.

All the patents and applications referred to herein are hereby specifically, and totally incorporated herein by reference in their entirety in the instant specification.

The following Examples further define and describe embodiments of the present invention. Unless otherwise indicated, all parts and percentages are by weight.

EXAMPLES

Example 1

Preparation and Testing of Photoreceptor Having Nano-Size Filler Dispersed in Charge Transport Layer Electrophotographic imaging members were prepared by dip-coating aluminum drums with charge transport layers of a polycarbonate binder (PcZ400) and m-TBD (N,N'-diphenyl-N,N'-bis(3-methylphenyl)-(1,1'-biphenyl)-4,4'diamine) in monochlorobenzene. Various amounts of nano-size aluminum oxide fillers having an average particle diameter of 39 nanometers and a specific surface area (BET) of 42 $m^2/g$ were added. The amounts of nano-size fillers were 0 percent (control), 5 weight percent, and 10 weight percent by weight of total solids. The nano-size fillers were added to the charge transport layer (25 micron).

A 25 micron transport layer was tested. The devices were tested using a surrogate wear fixture, a device which simulates wear by cascading single component developer over a rotating drum with subsequent removal of the toner by means of a blade cleaner. This fixture has been shown to be internally consistent and allows a ranking of potential candidates against one another.

The wear results are shown below in Table 1. These results show good wear results by use of the nano-size filler.

TABLE 1

| Percentage $Al_2O_3$ in Transport Layer | Wear results |
|---|---|
| 10 weight percent $Al_2O_3$ | 7.2 nm/kilocycle (2.0 nm/kilocycle standard deviation) |
| 5 weight percent $Al_2O_3$ | 16.8 nm/kilocycle (2.0 nm/kilocycle standard deviation) |
| 0 weight percent $Al_2O_3$ | 43 nm/kilocycle (6.5 nm/kilocycle standard deviation) |

Example 2

Preparation of Testing Photoreceptor having Nano-Size Filler Dispersed in Overcoat Layer The above procedure in Example 1 was repeated, except that the nano-size aluminum oxide was added to a 5 micron overcoat layer. Exactly as the previous example, polycarbonate, m-TBD hole transport small molecule and aluminum oxide were used.

Table 2 below shows the results of the testing. The results clearly show increased wear by use of the nano-size filler.

TABLE 2

| Percentage $Al_2O_3$ in overcoat | Wear results |
|---|---|
| 10 weight percent $Al_2O_3$ | 7.9 nm/kilocycle (1.5 nm/kilocycle standard deviation) |
| 5 weight percent $Al_2O_3$ | 12.1 nm/kilocycle (2.0 nm/kilocycle standard deviation) |
| 0 weight percent $Al_2O_3$ | 42 nm/kilocycle (4 nm/kilocycle standard deviation) |

While the invention has been described in detail with reference to specific embodiments, it will be appreciated that various modifications and variations will be apparent to the artisan. All such modifications and embodiments as may readily occur to one skilled in the art are intended to be within the scope of the appended claims.

We claim:

1. An electrophotographic imaging member comprising:

a substrate;

a charge transport layer comprising charge transport materials dispersed therein; and an overcoat layer, wherein at least one of said charge transport layer and overcoat layer comprise crystalline or spherical-shaped metal oxide nano-fillers having a particle size of from about 1 to about 250 nanometers.

2. An imaging member in accordance with claim 1, wherein said particle size is from about 1 to about 199 nanometers.

3. An imaging member in accordance with claim 2, wherein said particle size is from about 1 to about 100 nanometers.

4. An imaging member in accordance with claim 1, wherein said nano-size fillers have a surface area of from about 0.1 to about 75 $m^2/g$.

5. An imaging member in accordance with claim 1, wherein said nano-size filler is present in said at least one of said charge transport layer and overcoat layer in an amount of from about 0.1 to about 30 percent by weight of total solids.

6. An imaging member in accordance with claim 5, wherein said nano-size filler is present in at least one of said charge transport layer and overcoat layer in an amount of from about 3 to about 15 percent by weight of total solids.

7. An imaging member in accordance with claim 1, wherein said nano-size filler is a metal oxide selected from the group consisting of silicon oxide, aluminum oxide, chromium oxide, zirconium oxide, zinc oxide, tin oxide, iron oxide, magnesium oxide, manganese oxide, nickel oxide, copper oxide, conductive antimony pentoxide, indium tin oxide, and mixtures thereof.

8. An imaging member in accordance with claim 7, wherein said nano-size filler is aluminum oxide.

9. An imaging member in accordance with claim 1, wherein said nano-size filler is produced by plasma reaction of the filler.

10. An imaging member in accordance with claim 1, wherein said nano-size filler is produced by vapor phase synthesis of the filler.

11. An imaging member in accordance with claim 1, wherein said overcoat comprises said nano-size filler.

12. An imaging member in accordance with claim 11, wherein said nano-size filler is aluminum oxide.

13. An imaging member in accordance with claim 11, wherein said overcoat comprises a binder selected from the group consisting of polycarbonate resin, polyester, polyarylate, polyacrylate, polyether, and polysulfone.

14. An imaging member in accordance with claim 1, wherein said charge transport layer comprises said nano-size filler.

15. An imaging member in accordance with claim 14, wherein said nano-size filler is aluminum oxide.

16. An imaging member in accordance with claim 14, wherein said charge transport layer comprises polycarbonate and small molecules.

17. An imaging member in accordance with claim 1, wherein said charge transport layer and said overcoat layer both comprise said nano-size filler.

18. An electrophotographic imaging member comprising:

a substrate;

a charge transport layer comprising charge transport materials dispersed therein; and an overcoat layer, wherein said overcoat layer comprises crystalline or spherical-shaped aluminum oxide nano-fillers having a particle size of from about 1 to about 250 nanometers.

19. An image forming apparatus for forming images on a recording medium comprising:

a) a photoreceptor member having a charge retentive surface to receive an electrostatic latent image thereon, wherein said photoreceptor member comprises a substrate, a charge transport layer comprising charge transport materials therein, and an overcoat layer, wherein at least one of said charge transport layer and said overcoat layer comprise crystalline or spherical-shaped metal oxide nano-fillers having a particle size of from about 1 to about 250 nanometers b) a development component to apply a developer material to said charge-retentive surface to develop said electrostatic latent image to form a developed image on said charge-retentive surface;

c) a transfer component for transferring said developed image from said charge-retentive surface to another member or a copy substrate; and d) a fusing member to fuse said developed image to said copy substrate.

* * * * *